US005882409A

United States Patent [19]

Stahl

[11] Patent Number: 5,882,409

[45] Date of Patent: Mar. 16, 1999

[54] COATING DEVICE WITH WORKPIECE SENSOR

[75] Inventor: Gerhard Stahl, Ahrweiler, Germany

[73] Assignee: Josef Schiele oHG, Niederzissen, Germany

[21] Appl. No.: 944,375

[22] Filed: Oct. 6, 1997

[30] Foreign Application Priority Data

Oct. 11, 1996 [DE] Germany ..... 296 17 524.2

[51] Int. Cl.[6] ..... B05C 11/00

[52] U.S. Cl. ..... 118/712; 118/668; 118/676; 118/677; 118/DIG. 11; 118/DIG. 13; 118/200; 118/253; 118/256; 239/437; 239/451; 401/193

[58] Field of Search ..... 118/668, 676, 118/677, 712, DIG. 11, DIG. 13, 200, 253, 256, 500; 239/437, 451; 401/193

[56] References Cited

U.S. PATENT DOCUMENTS

| | | | |
|---|---|---|---|
| 3,885,315 | 5/1975 | Polselli et al. | 401/193 |
| 4,135,651 | 1/1979 | Hession et al. | 401/193 |
| 4,260,273 | 4/1981 | Hemperly, Jr. et al. | 401/193 |
| 5,131,349 | 7/1992 | Keller et al. | 401/193 |
| 5,298,072 | 3/1994 | Schiele et al. | 118/681 |
| 5,344,668 | 9/1994 | Rempe et al. | 118/676 |
| 5,453,302 | 9/1995 | Chaudhry et al. . | |
| 5,520,733 | 5/1996 | Doi et al. | 118/256 |

FOREIGN PATENT DOCUMENTS

| | | | |
|---|---|---|---|
| 3413066 | 10/1985 | Germany | 118/256 |
| 93 17 655 .4 | 3/1994 | Germany . | |

*Primary Examiner*—Peter Chin
*Assistant Examiner*—Michael P. Colaianni
*Attorney, Agent, or Firm*—Michael J. Striker

[57] ABSTRACT

A coating device has a coating head for applying a coating strip of a flowable coating material on a workpiece surface and having an application nozzle and a suction nozzle located near one another, a holder, a movement unit through which the coating head is supported on the holder to be moveable in at least one direction, at least one sensor unit which sensors a position of the workpiece and adjusts the coating head, the movement unit for moving the coating head being oriented so that it presses the coating head at least in one direction against the workpiece, the sensor unit being formed as a mechanical contact sensor bringable in an engagement with the workpiece and fixedly connected with the coating head to have a limited movement.

9 Claims, 3 Drawing Sheets

COATING DEVICE WITH WORKPIECE SENSOR

BACKGROUND OF THE INVENTION

The present invention relates generally to coating devices.

More particularly, it relates to a coating device which has a coating head for applying a coating strip of a flowable coating material on a workpiece surface as well as an application nozzle and a suction nozzle located near one another at a small distance from the workpiece surface. Also, the coating device has a holder for supporting the coating head moveably in at least one direction, and a sensing element which determines the position of the workpiece and provides a corresponding adjustment of the coating head.

A coating device of the above mentioned general type is disclosed for example in the German document DE-GM 93 17 655.4. In this device the sensing element is formed by distance sensors which determine the availability and the position of the workpiece and adjust the coating head through a unit for its movement so that a suitable relative position with respect to the workpiece is provided. A coating head of the above mentioned general type aspirates surrounding air with a suction nozzle, whose edge moves at a relatively small distance from the workpiece surface over the surface. The application nozzle through which air is supplied applies varnish or another flowable material onto the workpiece surface which is located close to it. The suction nozzle is then moved over the applied material to aspirate the excess of the material. The aspirated material is then separated in a suction device from air and recovered or discarded.

The more uniform and small the distance between the edge of the above mentioned nozzles around the opposite workpiece surface, the more uniform the produced coating, and the more accurate can all parameters be controlled. As a result, a minimum material to be applied reaches the suction nozzle.

The sufficiently exact position of the workpiece can be obtained with known distance sensing elements with their suitable design, and a subsequent regulation can control the coating head by means of a movement unit so that it maintains its relative position to the workpiece with any small tolerances, even when it must be twisted or delayed, and thereby it must be moved in alternating relative position on the coating head.

Such regulation was extremely expensive and also susceptible to disturbances. If the regulation is simplified, then loss of the regulating accuracy and in particular the response speed can be caused. A fast responsive, simple regulation has a tendency to immanent regulating oscillations, and the damping of these regulating oscillations worsens the response conditions.

The disturbance sensitivity of such regulation is characteristic especially for small, manual operations in which only a single machine is provided with a coating device. In the case of a failure, a redundant machine can not be used.

SUMMARY OF THE INVENTION

Accordingly, it is an object of the present invention to provide a device of the above mentioned type, which ensures such a control that it is substantially not susceptible to disturbances and guarantees continuous position correction of the coating head in a simple manner.

In keeping with these objects and with others which will become apparent hereinafter, one feature of the present invention resides in a coating device in which a unit for moving the coating head is formed so that it presses the coating head at least in one direction against a workpiece, and a sensing element is formed as a mechanical contact sensor which is bringable in a displaceable engagement with the workpiece, fixedly connected with the coating head, and limits its movement.

The unit for movement does not have to move the coating head in a controlled manner over exactly dosed path portions, but instead it loads the coating head. In cases of emergency, this unit can be formed by a weight of the coating head which lowers onto the workpiece surface and is supported from below the mechanical contact sensing element which on the one hand is seated on the workpiece, and on the other hand is fixedly connected with the nozzle of the coating head or with the head. It is thereby guaranteed that the distance between the nozzles and the coating head on the one hand and the workpiece on the other hand remains the same.

The accuracy with which the coating head follows irregularities of the workpiece during its movement finally does not depend only on the distance between the contact sensor and the nozzle openings. Since the displacement speed of the workpiece is relatively small, it is not necessary to take into consideration that the coating head during position changes is lifted from the workpiece surface.

Since the longitudinal changes of the workpiece cross-section relative to the coating head are performed only uni-dimensionally, it suffices to have a mechanical contact sensor and a movement unit. If the longitudinal changes are performed two-dimensionally, a second mechanical contact sensor and a second movement unit are needed.

The contact sensor can be connected with the coating head through a rigid linkage. Preferably, it is mounted however directly on the receiving head and as close as possible to its nozzle arrangement. Therefore, the position of the workpiece which is sent by the contact sensor substantially corresponds to the point before the nozzle arrangement.

The contact sensor can be formed as a rounded, rigid sensing finger which slides on the workpiece during its movement. It should be mentioned that this workpiece movement is a relative movement between the workpiece and the coating head. It is also possible to arrange the workpiece stationary and to move the coating head relative to the stationary workpiece.

Preferably however, the contact sensor is formed as rotatably supported element which is in engagement with the workpiece surface and rolls on it. Therefore, a maximum fine treatment of the workpiece is performed, and its movement is not blocked by the contact sensor.

The contact sensor can be formed as a profile roller which engages with a formation of the workpiece, such as a roller with a ring groove to roll on an edge of the workpiece. Therefore, it follows positively the position changes of the workpiece.

In an alternative embodiment or additionally, it is also possible to provide at least two rollers which are supported against the workpiece opposite to one another and therefore form-lockingly transfer all position changes of the workpiece to the coating head.

The unit for movement of the coating head, as mentioned above, can be formed as an own weight of the coating head. However, it must have the freedom to follow the force action of its own weight.

The unit for movement of the coating head can be advantageously formed by at least two rollers which are arranged opposite to one another and are in positive engagement with the workpiece. It is therefore guaranteed that the coating head is not lifted from the workpiece in response to substantially fast position changes.

The workpiece can be delayed or deformed. It can be subjected to its own vibrations when it is coated. In this case, in accordance with the present invention, the coating process is performed under optimal conditions.

However, in order to avoid loading peaks, a dampening is utilized. This dampening must not however lead to substantial delay of the movement course. For example, the rollers which are in engagement with the workpiece can be coated with a dampening material such as rubber. Also, a certain friction within the unit for movement of the coating head can be provided for obtaining a certain dampening.

Another alternative to the unit for movement of the coating head is a spring arrangement. It ensures that the forces which act in the nominal position of the coating head on the contact sensor and the workpiece are maintained low, but increase with increasing deviation. The adjustment of a pre-tensioning is possible. By bridging with a non-springy member, all springs can be deactivated when necessary.

For coating of endless profiles or jointless profile portions adjoining one another, the inventive coating device is suitable also when the profiles have coarse errors in their shapes and are moved during coating.

When however profile portions are coated which are spaced from one another at certain distances, then at the end of each profile portion, the contact sensor searches for a workpiece to sense. Therefore, the coating head is moved in an end position in which possibly the next, oncoming profile portion can not run in the coating head since in this end position the tool is offset relative to it and located in its nominal position.

For eliminating this problem, a device is proposed which fixes the position of the coating head when it approaches the end of a corresponding coated workpiece. The fixation is removed when coating of the next workpiece is started. Thereby a disturbance-free coating of the workpieces which follow one another with distances therebetween are provided.

The application nozzles of the known coating head are generally provided with round openings. An especially economical and uniform coating is however possible with a coating head in which the application nozzle opens with a slot extending transversely to the movement direction of the workpiece. The application with such a slot nozzle is so uniform that for obtaining a flat coating the same workpiece can be coated in successive and adjoining application strips.

With such a coating head however, its arrangement in a small and uniform distance from workpiece is especially important. Therefore such a coating head operates in an especial advantageous alternating action with a coating device of the present invention.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF PREFERRED EMBODIMENTS

Figure 1:
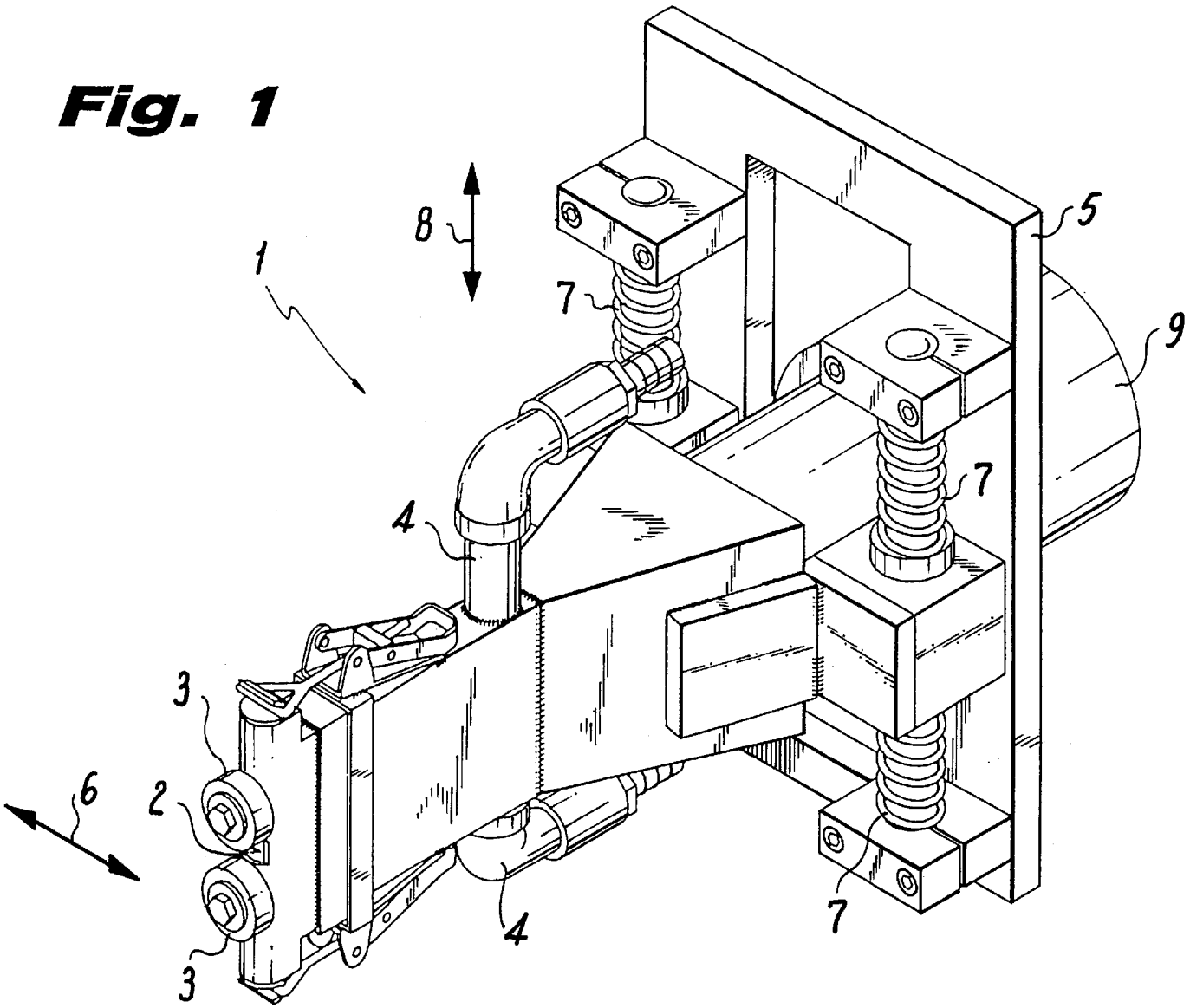
FIG. 1 is a schematic representation of a first embodiment of a coating device with a coating head, a holder and contact sensors, in an inclined view.

FIG. 1 is a view showing a substantially conventional coating head 1 which is provided at its end with a slot 2. An edge of an application workpiece to be coated passes through the slot 2. It is not shown in FIG. 1 and moves in direction of a double arrow 6 relative to the coating head 1.

The coating head 1 has further two conductor pipes 4 connected with flexible conductors for a varnish supply. A suction connector pipe 9 is arranged at its rear side for connection to a flexible suction conduit. The coating head 1 engages with two guides of each vertical rod. Both rods are mounted at both sides and behind the coating head 1 on a stationary holder 5. The coating head 1 can move along both rods in direction of the arrow 8.

Helical springs 7 abut against the upper or lower end of the rods on the holders and sit with their other ends on the guides which are fixedly connected with the coating head 1. They hold the coating head 1 in a central position from which it can move in direction of the double arrow 8 against the action of the upper or lower springs 7.

A guiding roll 3 is mounted on the front side of the coating head 1 over and under the coating slot 2. The guiding rollers 3 are freely rotatable on a rotary axis arranged on the coating head 1 and extending perpendicular to the directions 8 and 6.

The guiding rollers 3 are spaced from one another. A distance between the guiding rollers is selected so that a not shown workpiece is guided between the rollers 3 practically without any gaps when it is transported through the coating slot 2 in direction of the arrow 6.

When the edge of the workpiece is distorted, both guiding rollers 3 follow the course of the workpiece and move the coating head along the arrow 8 upwardly or downwardly. Thus, the guiding rollers 3 form a mechanical contact sensor. The springs 7 have the main purpose to return the coating head 1 to its nominal position when no workpiece is available.

Figure 2:
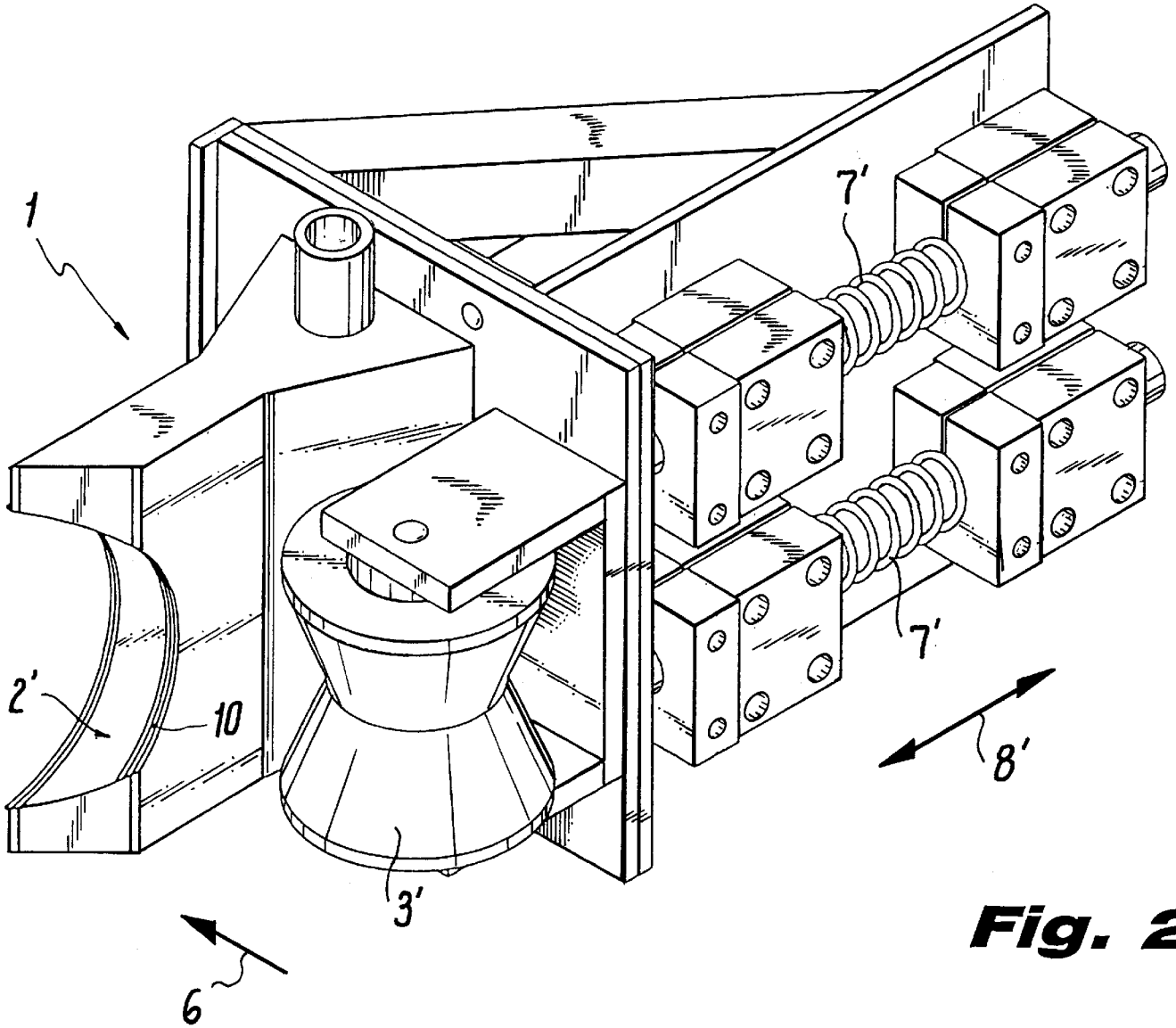
FIG. 2 is a schematic representation of a second embodiment of a coating device in accordance with present invention with a coating head, a holder and a contact sensor, in an inclined view.

FIG. 2 shows a second embodiment of the coating device in accordance with the present invention. The same references numerals are provided to identified identical elements shown in FIG. 1.

The coating slot 2' has an arcuate contour and is provided at its inlet over its entire width with a slot chamber 10 for performing the. varnish application. Such a coating head requires a special thorough guidance relative to the workpiece which moves along the arrow 6 through the coating slot 2'. A movement of the workpiece in the opposite direction is not possible.

A helical spring arrangement 7' loads the coating head 1 in direction toward the workpiece and can move in the directions of the double arrow 8'.

The guiding roller 3' is arranged near the coating head 1 and rotatably supported in a bracket. The bracket is fixedly mounted on the same carrier as the coating head 1. The rotary axis of the guiding roller 3' extends, as in the first embodiment, perpendicular to both direction 6, 8. The support is performed through ball bearings. They both are formed practically as fixed bearings to avoid an axial play of the guiding roller 3'.

The guiding roller 3' has an hour-glass shape. It narrows from its both ends to its center and forms in it a ring-shaped depression which can guidingly run over the workpiece. The spring arrangement 7' presses the guiding roller 3' always in engagement with the workpiece, so that the coating slot 2' is always located at a correct distance from the workpiece surface.

A similar control of the coating head 1 can be performed also in a second direction transversely to the double arrow 8'. Therefore, the coating head 1 can coat with varnish also multi-dimensional curved or vibrating workpieces.

Figure 3C:
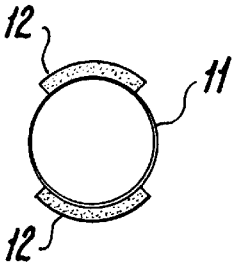
FIG. 3*c* is a cross-section through the workpiece, after passage of the first coating station of the device of FIGS. 3*a* and 3*b*.
Figure 3D:
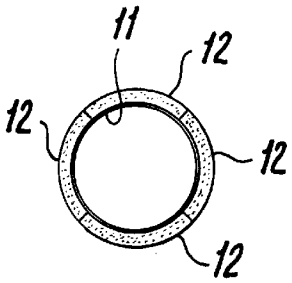
FIG. 3*d* is a view showing a section through the workpiece after full passage of the device of FIGS. 3*a* and 3*b*.
Figure 3B:
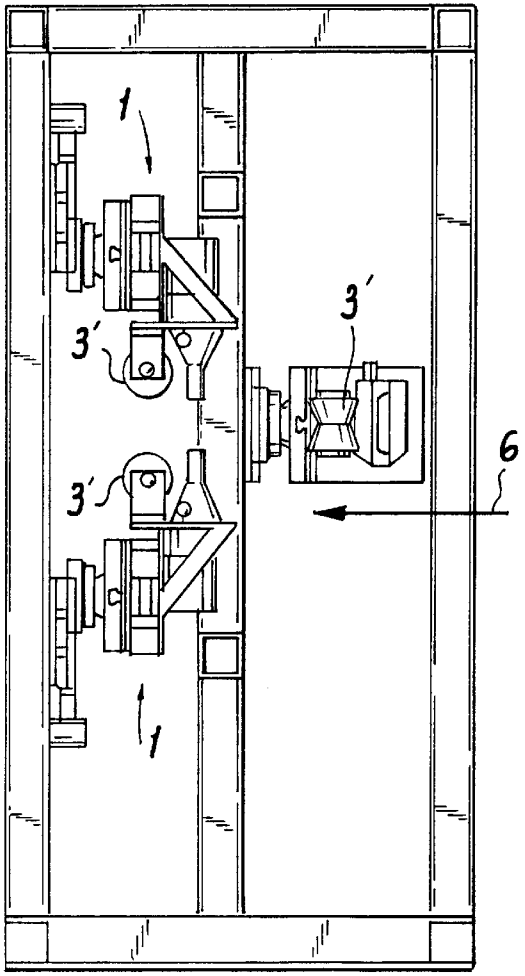
FIG. 3*b* is a longitudinal section through the coating device of FIG. 3*a* as seen transversely to the direction of the workpiece stroke.
Figure 3A:
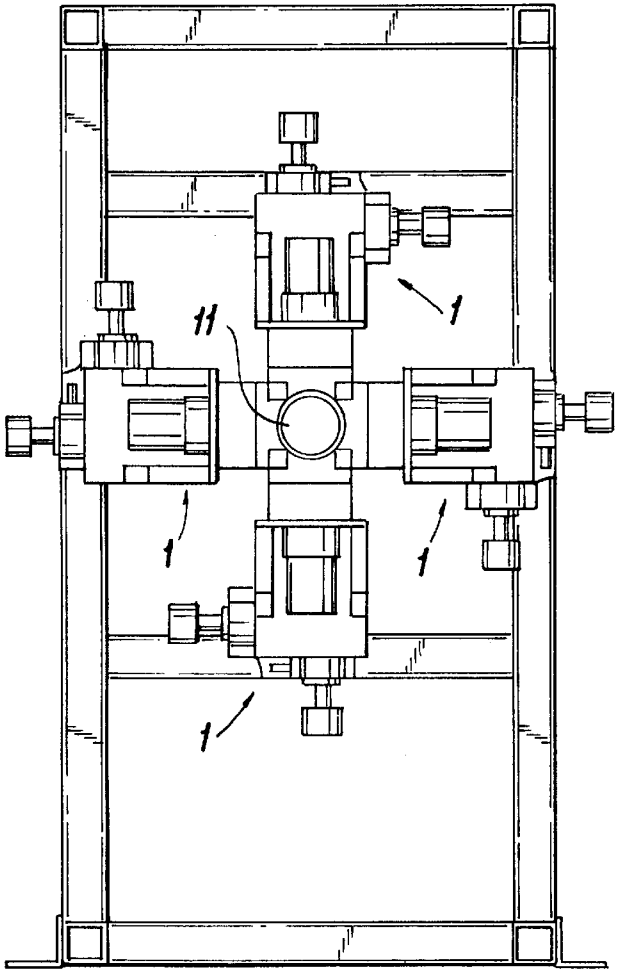
FIG. 3*a* is a schematic view of a coating devices for coating heads as seen in direction of a workpiece stroke.

FIGS. 3*a* and 3*b* show a coating device provided with four coating heads 1 as shown in FIG. 2.

The coating heads 1 are offset relative to one another by 90°. They face one another in a vertical direction for a first working step and face one another in a horizontal direction for a second working step as shown in FIG. 3*b*. Each coating head 1 is oriented so that varnish coats a quadrant on an outer surface of a pipe 11 with a round cross-section, which forms the workpiece. When the pipe 11 moves in direction of the arrow 6 of FIG. 3*b* through the coating device, first the upper and lower side of the tube 11 is provided with a varnish layer 12 as shown in FIG. 3*c* and then both horizontally opposite sides are provided with the varnish layer as shown in FIG. 3*d*.

The guiding rollers 3 of two opposite coating devices are supported in opposite directions over the workpiece 11. Therefore, the workpiece 11 can not be deformed by the force of the spring arrangement 7'.

It will be understood that each of the elements described above, or two or more together, may also find a useful application in other types of constructions differing from the types described above.

While the invention has been illustrated and described as embodied in coating device, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A coating device, comprising a coating head for applying a coating strip of a flowable coating material on a workpiece surface and said coating head having application means for applying said coating material and suction means, positioned to remove an excess of the coating material form said workpiece surface a holder for holding said application means and suction means; a movement unit through which said coating head is supported on said holder so that said coating head is moveable in at least one direction; at least one sensor which senses a position of the workpiece and adjusts said coating head, said movement unit for moving said coating head being oriented so that it presses said coating head at least in one direction against said workpiece, said sensor being fixedly connected with said coating head and formed as a mechanical contact sensor which is displaceably engageable with an edge of the workpiece so that when said coating head and the workpiece move relative to one anotherwith said mechanical contact sensor displaceably engaged with the workpiece, said mechanical contact sensor follows the edge of the workpiece and moves said coating head in correspondence with the edge of the workpiece.

2. A coating device as defined in claim 1, wherein said mechanical contact sensor is mounted on said coating head adjacent to said application means and said suction means.

3. A coating device as defined in claim 1, wherein said mechanical contact sensor is supported rotatably and oriented for rolling on the workpiece.

4. A coating device as defined in claim 3, wherein said mechanical contact sensor is formed by at least one roller with a periphery which is profiled for guided rolling on the workpiece.

5. A coating device as defined in claim 3, wherein said mechanical contact sensor includes at least two rollers which are engageable with the workpiece to be supported on one another.

6. A coating device as defined in claim 1; and further comprising means for dampening a movement of said coating head.

7. A coating device as defined in claim 1; and further comprising means for dampening a movement of said mechanical contact sensor.

8. A coating device as defined in claim 1, wherein said movement unit for moving said coating head is formed as a spring arrangement.

9. A coating device as defined in claim 1, wherein said application means is formed as a slot which extend transversely to a movement direction of the workpiece.

* * * * *